US005785594A

United States Patent [19]

Seibert, Jr. et al.

[11] Patent Number: 5,785,594

[45] Date of Patent: Jul. 28, 1998

[54] SPINNING WHEEL AMUSEMENT DEVICE

[75] Inventors: William E. Seibert, Jr., Beachwood; Robert C. Betti, Upper Saddle River, both of N.J.

[73] Assignee: H. Betti Industries, Inc., Carlstadt, N.J.

[21] Appl. No.: 759,972

[22] Filed: Dec. 3, 1996

[51] Int. Cl.[6] ..... A63F 5/02; A63F 7/02

[52] U.S. Cl. ..... 463/17; 273/143 E; 273/142 D; 273/142 E; 273/138.2

[58] Field of Search ..... 273/143 E, 143 D, 273/143 C, 143 R, 142 D, 142 E, 138.2, 138.1, 121 B, 138.3; 463/17, 20

[56] References Cited

U.S. PATENT DOCUMENTS

| | | | |
|---|---|---|---|
| 514,418 | 2/1894 | Dennis . | |
| 657,522 | 9/1900 | Deiters et al. . | |
| 1,538,449 | 5/1925 | Schulz . | |
| 1,656,272 | 1/1928 | Ekstein . | |
| 1,996,143 | 4/1935 | Callison | 194/205 |
| 2,534,730 | 12/1950 | Peacock | 273/387 |
| 2,616,699 | 11/1952 | Franks | 273/120 R |
| 3,405,459 | 10/1968 | Belokin, Jr. | 434/433 |
| 3,592,471 | 7/1971 | Swimmer . | |
| 4,061,334 | 12/1977 | Kanno . | |
| 4,210,331 | 7/1980 | Kulesza et al. . | |
| 5,322,283 | 6/1994 | Ritchie et al. | 273/127 C |
| 5,360,214 | 11/1994 | Harmen | 273/144 B |
| 5,509,654 | 4/1996 | Takemoto et al. | 273/121 B |
| 5,584,763 | 12/1996 | Kelly et al. | 463/17 |

FOREIGN PATENT DOCUMENTS

| | | | |
|---|---|---|---|
| 160157 | 11/1985 | European Pat. Off. | 273/142 E |
| 3717593 | 12/1988 | Germany | 273/142 E |
| 404146781 | 5/1992 | Japan | 273/121 B |
| 405192435 | 8/1993 | Japan | 273/121 B |

OTHER PUBLICATIONS

Funtime Company, *Wheel of Fortune*.

K. W. Systems Ltd., *Wheel of Fortune*, Mar. 3, 1995.

Photograph of Dial-A-Deal Ltd. Inc'sAmusement Device.

*Primary Examiner*—Benjamin H. Layno

*Attorney, Agent, or Firm*—Sofer & Haroun, LLP

[57] ABSTRACT

A spinning wheel amusement device having a receiving guide for receiving a token or coin which is deposited on to a spinning wheel which is rotated via a motor. The spinning wheel is provided with a plurality of receptacles spaced about its periphery for receiving the token or coin therein. A peripheral token guide surrounds the spinning wheel and directs tokens or coins not successfully received in a receptacle on the spinning wheel. The device includes a microprocessor configured to control and operate different components of the system. The device is also provided with sensors for detecting the presence of a token or coin received in a receptacle on the spinning wheel and for determining the position of the spinning. Each receptacle has a corresponding value such that an award, such as number of tickets or vouchers, are dispensed when a coin or token is successfully received in a receptacle on the spinning wheel. Various lights, scoring indicators and sounds may be added to add to the attraction and excitement of the game.

25 Claims, 6 Drawing Sheets

SPINNING WHEEL AMUSEMENT DEVICE

FIELD OF THE INVENTION

This invention relates to amusement devices, and more particularly, to a microprocessor-based spinning wheel amusement device.

BACKGROUND OF THE INVENTION

Arcade games and casino slot machine type games have been popular since the early 1900's. As such, the prior art is replete with references disclosing games such as pinball, for use in arcades or in homes, as well as casino-type games of chance such as slot machines and pachinko.

In 1926, Ekstein, in U.S. Pat. No. 1,656,272 disclosed a game comprising a rotating circular surface powered by a clockwork motor, and upon which animate or inanimate figures were situated. Each of the figures on the circular surface includes a receiving pocket for receiving a ball or sphere which is directed toward the rotating circular surface by rolling down a chute.

In 1932, Callision, in U.S. Pat. No. 1,996,143 disclosed an amusement device comprising a vertical rotating playing surface having receiving channels and barriers positioned in the periphery of the playing surface. This device which was mechanically powered and coin operated, included a plunger which propelled a spherical playing piece onto the playing surface where it was either received in the channels or deflect off a barrier. If the ball was received in a channel, points or a prize are awarded. If the ball struck a barrier it fell to an exit receptacle and no points or prize is awarded.

U.S. Pat. No. 3,405,459 (1966) to Belokin, teaches an animated educational and amusement device. This device comprises a circular electrically-powered motor driven rotating playing surface and utilizes balls, marbles or spheres as play pieces. The ball is generally introduced onto the playing surface at an upper portion from where it falls downward and caroms off a plurality of bumpers or pins dispersed on the playing surface and which deflect the ball as it rolls upon the playing surface. As the ball reaches the lower portion of the playing surface, it may be received in a cup and carried upward to be dropped again.

In 1994, Ritchie et al. disclosed in U.S. Pat. No. 5,322,283, a rotary ball receptacle for a pinball game. This reference discloses a circular rotary wheel which is positioned within a pinball machine. The rotary wheel is provided with receiving sockets for receiving a ball therein during pinball play. After a ball is received in one of the sockets, the ball is retained therein and the wheel rotates to expose a new unoccupied receiving socket. After all receiving sockets are occupied, the wheel releases all the balls for simultaneous multiple ball pinball play. The rotary wheel is rotated by an electric motor and is controlled by optical sensors. The optical sensors provide signals to a microprocessor indicative of the relative rotation of the wheel.

In U.S. Pat. No. 5,509,654 (1996), Takemoto et al. disclose a game machine similar to "Pachinko" (Japanese upright pinball) which comprises a matrix sensor positioned inside the game so as to permit control of the path the ball as it falls across the game surface such that excessive winning or losing is made controllable.

However, none of the above-identified references disclose a spinning wheel amusement device that provides a plurality of options to the operator to vary the conditions of the game, or awards so as to maintain the player's interest.

OBJECTS AND SUMMARY OF THE INVENTION

It is thus a general object of the present invention to provide a spinning wheel amusement device for play in amusement arcades, gaming casinos and homes.

A more specific object of the present invention is to provide a spinning wheel amusement device which accepts a playing piece inserted by a player and which in turn provides a prize or award to the player.

It is another object of the present invention to provide an electrically-powered spinning wheel amusement device provided with a rotating playing surface having various sized receptacles dispersed about the periphery of the playing surface for receiving the playing piece inserted by the player.

It is further object of the present invention to provide a microprocessor-based spinning wheel amusement device that has sensor means for sensing the presence of a playing piece which is received in a receptacle on the spinning wheel, and awarding a prize corresponding to the receptacle in which the playing piece has been received.

In accordance with one aspect of the present invention, a spinning wheel amusement device is provided and which comprises a playing piece receiving guide or conduit for receiving a playing piece, which may include tokens, coins or marbles, and which are inserted into the device by a player via an external slot. The receiving guide directs the playing piece to a playing area which includes a spinning wheel provided with receptacles or slots positioned about its periphery. When the playing piece enters the playing area it may be received in one of the receptacles on the spinning wheel, or it may travel around the spinning wheel and fall withing an exiting guide which directs the playing piece out of the playing area, thus ending the game for the player. If the playing piece is received in one of the receptacles on the spinning wheel, the player has won. As a reward, tickets are dispensed to be accumulated and traded in for a prize. Alternatively, the device of the present invention may be configured to award additional playing pieces in lieu of tickets.

The receptacles dispersed about the periphery of the spinning wheel are generally semi-circular slots or openings of a single or differing size, with the different sizes being dispersed randomly or at fixed intervals about the spinning wheel. In general, "small win" receptacles which award small or lesser value prize, occur at a greater frequency about the spinning wheel. "Big win" receptacles are positioned about the periphery of the spinning wheel at a lesser frequency and provide a larger award when a playing piece is received therein. An essence of player skill may be added to the game by providing an adjustment arm at the end of the receiving guide. The adjustment arm may be fixed to provide a surface off which the playing piece is deflected before entering the playing area. Although fixed, the angle of the adjustment arm may be altered from the interior of the device by the operator. The adjustment arm may also be made adjustable by the player such that it may be manually angled by the player attempting to deflect the playing piece into a particular receptacle. Furthermore, the adjustment arm may be automatically adjusted by a microprocessor positioned within the device and which positions the adjustment arm depending upon current award percentages.

The game of the present invention is advantageously microprocessor-based, and is provided with sensing means such as optical, electrical or mechanical sensors, which are preferably positioned beneath the spinning wheel. If a playing piece is successfully received in a receptacle on the spinning wheel, the sensors detect the presence of the playing piece in the receptacle. The sensors then provide a signal to the microprocessor indicating the existence of a playing piece in a receptacle. The microprocessor tracks the location of all the receptacles and identifies the receptacle into which the playing piece has been received. The microprocessor then awards the player a predetermined value corresponding to the identified receptacle.

The spinning wheel is preferably provided with an additional sensing means for determining and tracking the spinning wheel position. The microprocessor also controls the spinning wheel, sounds, and displays which may be added to the device to attract player's and to retain their interest as the game is played.

The above description sets forth rather broadly the more important features of the present invention in order that the detailed description thereof that follows may be understood, and in order that the present contributions to the art may be better appreciated. Other objects and features of the present invention will become apparent from the following detailed description considered in conjunction with the accompanying drawings. It is to be understood, however, that the drawings are designed solely for the purposes of illustration and not as a definition of the limits of the invention, for which reference should be made to the appended claims.

DETAILED DESCRIPTION OF THE DRAWINGS

In the drawings in which like reference characters denote similar elements throughout the several views:

FIG. 1*a* illustrates a front perspective view of one embodiment of the spinning wheel amusement device according to the present invention;

FIG. 1*b* illustrates a front plan view of the playing area of one embodiment of the spinning wheel device according to the present invention, and including a spinning wheel positioned on the playing area;

DETAILED DESCRIPTION OF THE INVENTION

Figure 1A:
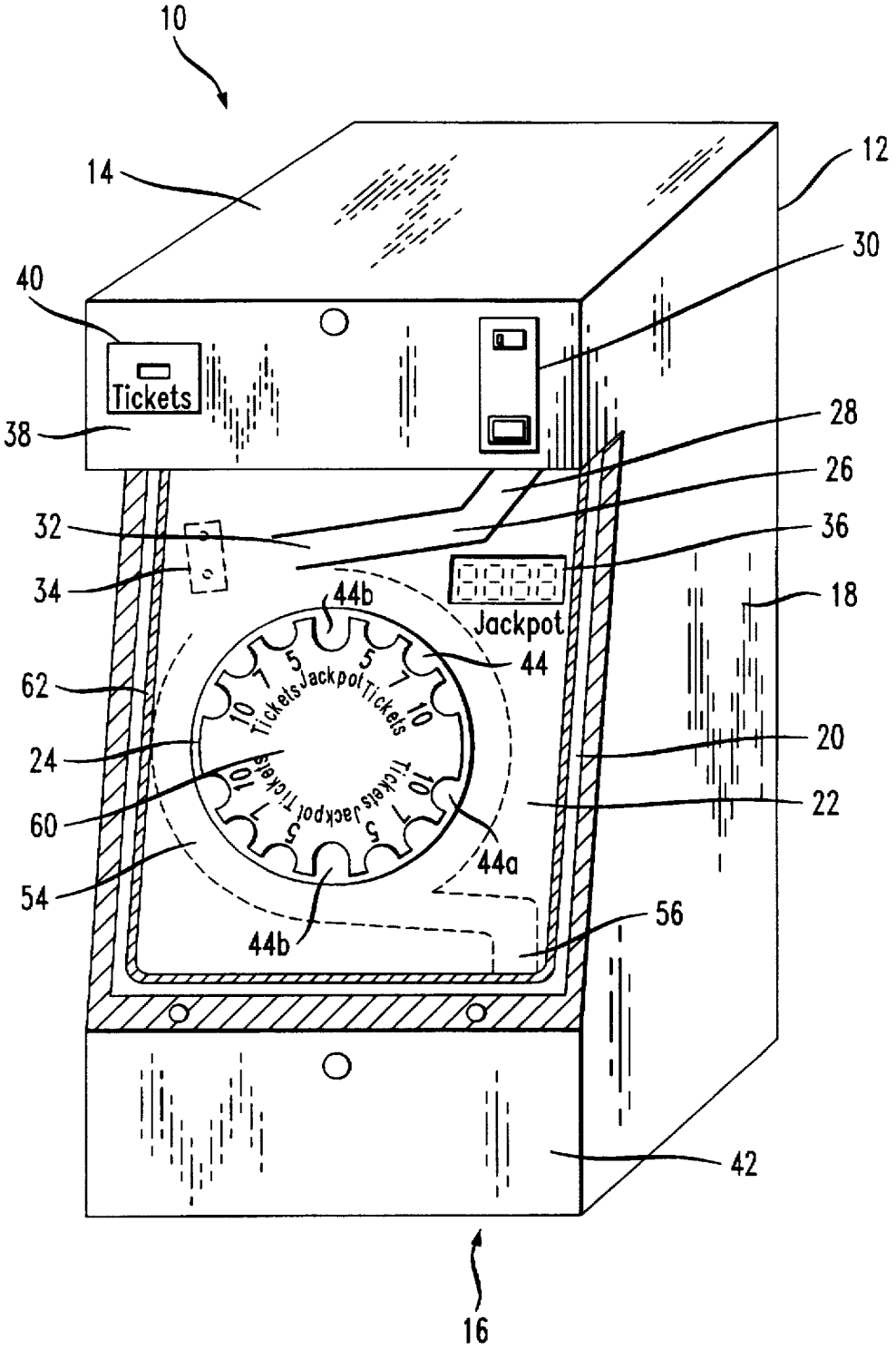

With initial reference to FIG. 1*a*, a spinning wheel amusement device 10 is shown according to one embodiment of the present invention. Spinning wheel amusement device 10 is comprised of a housing 12 having a top surface 14, a base 16 and a peripheral enclosing side wall 18. Spinning wheel amusement device 10 is further provided with a vertical front face 20 which is comprised of a translucent plate, such as glass or clear plastic. A front panel 22 is vertically disposed beneath front face 20 and is visible therethrough. Front panel 22 may include drawings or designs thereon, and may also be provided with controlled lights 62 to add to the game's appearance and to add elements of action and excitement.

Front panel 22 includes a spinning wheel 24 which is rotatably mounted upon front panel 22. A token guide or conduit 26 is defined between front face 20 and front panel 22, and has a first end 28 which leads from a token input slot 30 on peripheral enclosing side wall 18 proximate top surface 14. Second end 32 of token guide 26 extends along front panel 22 to a point proximate spinning wheel 24. An adjustment arm 34 may optionally be mounted on front panel 22 proximate second end 32 of token guide 26 for deflecting tokens (not shown), or other playing pieces such as coins or marbles, which travel through token guide 26 on to spinning wheel 24. It should be noted that the spinning wheel amusement device 10 is not limited to the configuration as illustrated in FIG. 1*a* and as recited hereinabove. For example, front face 20, along with front panel 22 and spinning wheel 24 may be positioned horizontally within housing 12.

With continued reference to FIG. 1*a*, peripheral enclosing side wall 18 of housing 12 may be configured in any of a variety of shapes including square, hexagonal, octagonal, etc., having the corresponding number of side walls. Housing 12 is further provided with a front surface 38 upon which token input slot 30 may be disposed and which may also include an award output slot 40 for distributing tickets or vouchers to players of the game. Housing 12 may also include a token storage chamber 42 for receiving and storing tokens or coins after the game has concluded. Token storage chamber 42 may be a door which opens into the housing 12, or a drawer which slides out from housing 12.

Figure 1B:
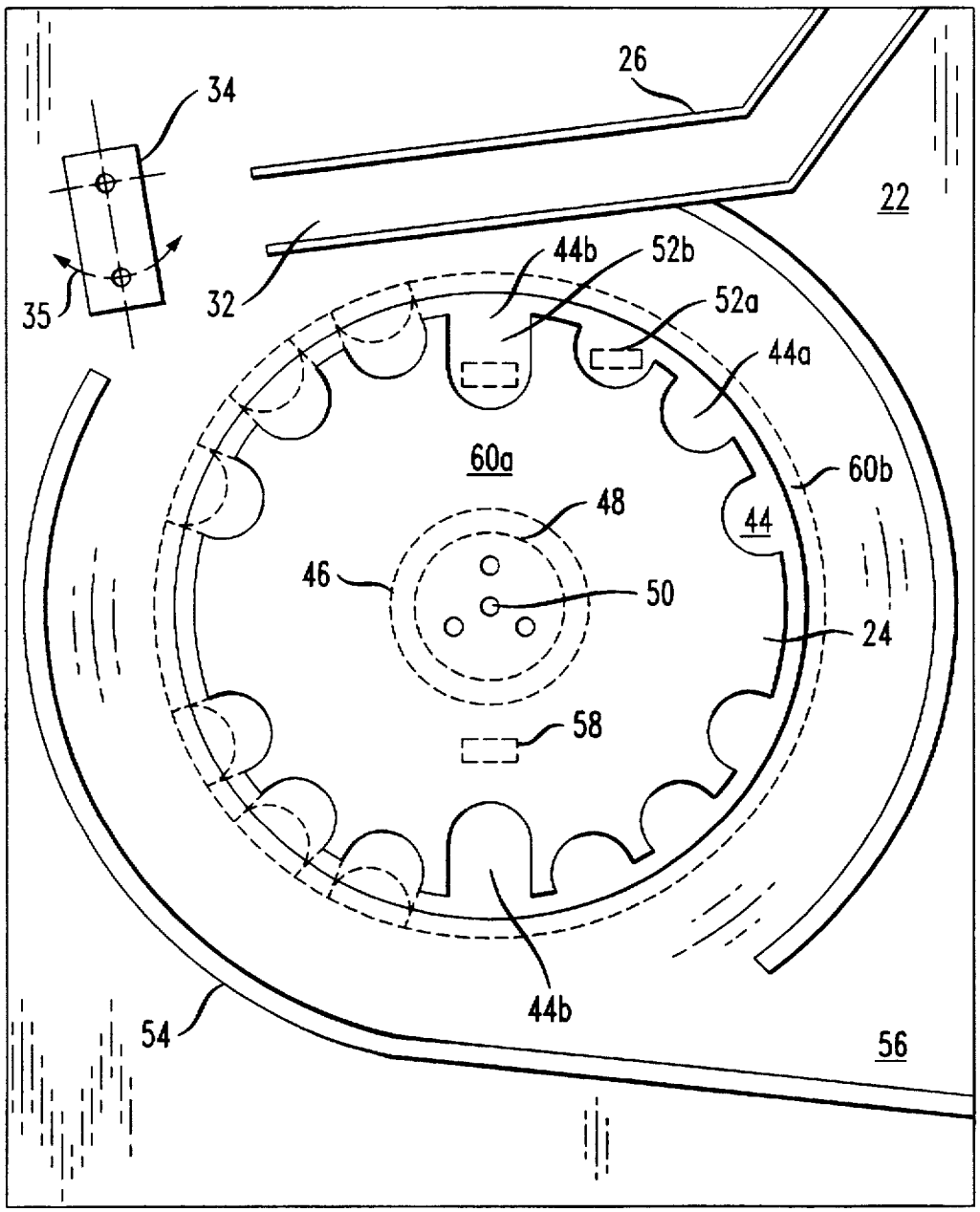

FIG. 1*b* provides a more detailed view of front panel 22 which illustrates token guide 26 disposed above spinning wheel 24. Adjustment arm 34 is positioned proximate second end 32 of token guide 26. Adjustment arm 34 which is mounted on front panel 22 may be fixed or swivelable as indicated by arrow 35. A peripheral token guide 54 is positioned about spinning wheel 24 and serves to direct the path of a token (not shown) which is received on spinning wheel 24 from token guide 26. Peripheral token guide 54 has an exit end 56 which leads directly to token storage chamber 42 (shown in FIG. 1*a*). It is to be noted that the device 10 of the present invention may also be configured without an adjustment arm 34. For example, instead of adjustment arm 34, token guide 26 may be extended to include a deflecting portion, in order to guide the tokens toward spinning wheel 24.

Spinning wheel 24 advantageously comprises a front plate **60*a* and a back plate 60*b* attached together so as to define receptacles 44, spaces or openings disposed about the periphery for receiving a token. Spinning wheel 24 may thus be any rotatable object capable of receiving and retaining a token, coin or other type of playing piece. As such, spinning wheel 24** is not limited to a circular shaped embodiment as illustrated in FIGS. 1*a* and 1*b*, and may exist as a triangle, square, pentagon, or any other shape which may be rotatable and which is provided with receptacles 44 or spaces configured for receiving a token and positioned about the periphery.

As illustrated in FIGS. 1*a* and 1*b*, spinning wheel 24 may comprise small or "small win" semi-circular receptacles **44*a* and large or "big win" semi-circular receptacles 44*b*, with point values allocated to each receptacle by the operator of the device. It is understood, however, that receptacles 44 may also all be of the same size, or may comprise a variety of large, small and intermediate sized receptacles. Additionally, the invention is not limited to semi-circular shaped receptacles 44 having a semi-circular shape, and receptacles of other shapes may be disposed on spinning wheel 24**.

To create an essence of chance and skill for playing the game, small win receptacles **44*a* may be more frequently dispersed about the periphery of spinning wheel 24**, as illustrated in FIGS. 1*a* and 1*b*. As such, a smaller prize or award is generally allocated to the frequently occurring small receptacles 44a. Big win receptacles 44b occur with lesser frequency about the periphery of spinning wheel 24, and hence are generally associated with a greater prize or award. The invention is not, however, limited in this respect, and the operator of the game may allocate any desired value of points to each receptacle 44. Additionally, different spinning wheels 24, such as spinning wheels of different shapes or having different receptacles thereon, may be substituted by either removing front face 20, or by opening a rear door or panel so as to exchange spinning wheel 24 from the interior. Furthermore, as shown in FIG. 1a, front panel 22 may also optionally include a display indicator 36 visible through front face 20 and which provides a visual indication of the current value of the big win receptacle 44b or a player's score. Display indicator 36 is preferably a four digit display, but may be configured to show any number of digits.

Spinning wheel 24 is rotated by a motor 46, which is positioned beneath front panel 22, as shown in FIG. 1b. Motor 46 which preferably rotates spinning wheel 24 in a clockwise direction, is mounted via motor flange 48, to front panel 22 at a centrally located point beneath spinning wheel 24. Axle 50 extends from motor 46 and is fixed to spinning wheel 24 such that the motor 46 rotates axle 50, which in turn causes spinning wheel 24 to rotate on front panel 22. It is understood, that motor 46 is not limited to mounting at a position centrally located below spinning wheel 24 on front panel 22 as indicated in FIG. 1b. For example, motor 46 may be placed elsewhere and comprise a belt (not shown) connected between motor 46 and axle 50 for rotating spinning wheel 24.

Figure 2:
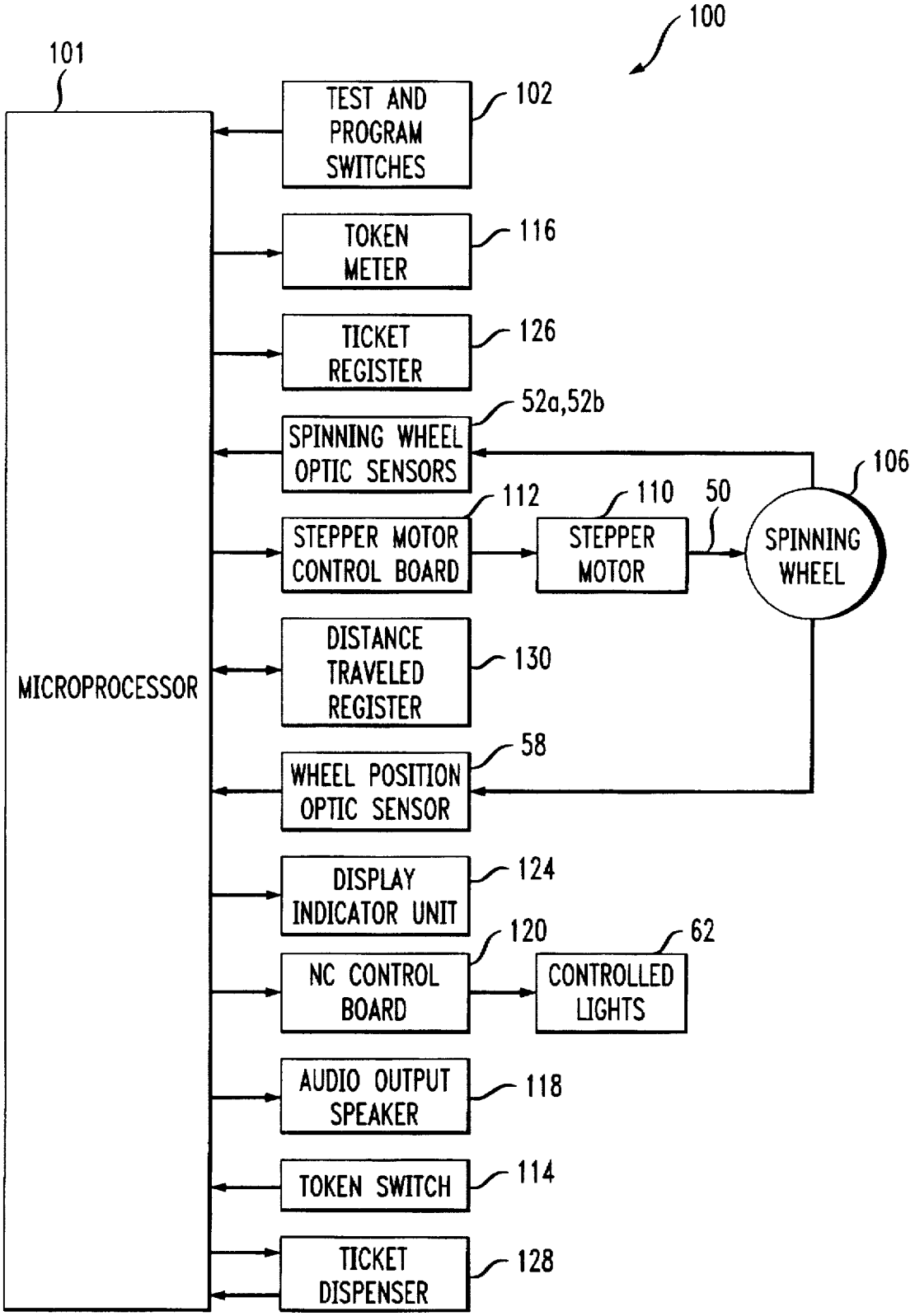
FIG. 2 is a block diagram which illustrates the structural relation of the hardware as recited with reference to the embodiment of the spinning wheel amusement device as shown in FIGS. 1*a* and 1*b;*

A sensing means is also provided, and is adapted to detect the presence of a token received in a receptacle 44 on spinning wheel 24 so that an award is provided corresponding to the particular receptacle 44 into which the token is received. The sensing means is preferably comprised of one or more sensors, indicated in FIG. 1b as spinning wheel optic sensors 52a and 52b. A microprocessor or central processing unit (C.P.U.), which is shown as block 11, in FIG. 2, is also arranged within housing 12 of spinning wheel amusement device 10. It is understood that the microprocessor may be connected externally as well.

Spinning wheel optic sensors 52a and 52b, are preferably optical sensors which comprise an emitter which emits a continuous stream of light and a receptor positioned alongside the emitter. When a token is received within a receptacle 44 on spinning wheel 24, the emitted light is reflected back and received by the receptor. The receptor then provides a signal to the microprocessor to indicate the presence of a token in a receptacle 44. The receptor may alternatively be positioned opposite the emitter and is configured to receive the continuous stream of light. Upon interference with or blockage of this stream of light, as when a token is successfully received in a receptacle 44 on spinning wheel 24, the receptor provides a signal to the microprocessor which indicates the presence of the token in the receptacle 44. Additionally, an electrical sensor wherein the receipt of a token in a receptacle closes a circuit may be used, as well as any of various types of mechanical sensors known in the art.

A wheel position optic sensor 58 (shown in FIG. 1b) is advantageously mounted beneath spinning wheel 24 and through front panel 22 for determining the position of spinning wheel 24. Wheel position optic sensor 58 is preferably a reflective sensor, however, the invention is not limited in this respect, and other optical or electrical sensors may be used as well.

As further illustrated in FIG. 1b, spinning wheel sensor 52a corresponds to small win receptacles 44a, such that when a token is successfully received in a small win receptacle 44a, it is detected by sensor 52a, which in turn provides a signal to the microprocessor to indicate the presence of the token therein. If a token is received into a big win receptacle 44b, spinning wheel optic sensor 52b detects the presence of a token in a big win receptacle 44b and provides a similar signal to the microprocessor indicating the presence of the token in big win receptacle 44b.

FIG. 2 illustrates a block diagram of a hardware system 100 for operating the spinning wheel amusement device, in accordance with one embodiment of the invention, although the invention is not limited in scope in that respect. A microprocessor 101 is configured to control and operate different components of the system by employing its input and output ports as explained hereinafter.

Spinning wheel 106 is configured to rotate via a rotating means, such as a spinning axle 50 of a stepper motor 110. Input terminals of stepper motor 110 are coupled to the output terminals of a stepper motor control board 112, which in turn is configured to receive control voltage signals from microprocessor 101. The operation of stepper motor is well-known. Briefly, stepper motor 110 includes a rotor that is a permanent cylindrical magnet with many poles around its circumference. The rotor (not shown) rotates inside two set of stator coils, each of which has a row of metal teeth. As stepper motor control board sends an excitation signal to a stator coil, the metal teeth become magnetized with alternate north and south poles. Reversing the excitation signal, reverses the sequence of the poles. The rotor travels a predetermined distance every time it receives an excitation signal. As a result, microprocessor 101 is configured to track the distance traveled by spinning wheel 106, in view of the signals sent to stepper motor 110. This distance is advantageously stored in a distance traveled register 130 allocated for that purpose. In order to measure this distance from a predetermined reference point on the spinning wheel, a solid marker is disposed on spinning wheel 106 so that the distance traveled is set to zero every time the solid marker passes by a wheel position optic sensor 58 as described hereinafter.

As explained above, wheel position optic sensor 58 is disposed adjacent spinning wheel 106, and provides a marker indication signal to microprocessor 101 every time the solid marker on spinning wheel 106 passes by it. In response to this marker indication signal, microprocessor 101 resets the distance traveled register 130 to zero, and begins updating the distance traveled register 130 based on the signals provided to stepper motor 110. Thus, as the stepper motor 110 rotates the spinning wheel 106, microprocessor 101 tracks the distance traveled by the marker in relation to the location of the wheel position optic sensor 58.

Spinning wheel optic sensors 52a, 52b are also disposed adjacent spinning wheel 106 as described above in reference with FIG. 1b. Output terminals of spinning wheel optic sensors 52a, 52b provide a token indication signal at an input terminal of microprocessor 101, whenever the presence of a token is detected in one of the receptacles located in the spinning wheel. As will be explained in more detail below, microprocessor 101 calculates the location or position of the receptacle that has received the token, by retrieving the position of the marker from the distance traveled register 130, at the time a token indication signal is received. Thus microprocessor 101 in accordance with one embodiment of the invention is programmed to determine the location of the receptacle that receives the token based on the position of the marker at the time the presence of the token is sensed.

Microprocessor 101 is also configured to receive signals from test and program switches 102. When playing of the spinning wheel amusement device 10 of the present invention commences, the device 10 is advantageously in a "non-error" or normal mode. Test and program switches 102 are monitored by microprocessor 101 and when they are activated while the game is in a "non-error" mode, they put the game into a "programming and bookkeeping mode". The "programming and bookkeeping mode" allows the operator of the game to set up the values that the game will award for all the receptacles 44 on spinning wheel 24, and it will display how may times players have landed in each receptacle 44. If the game is in an "error condition" (i.e. the device has depleted its ticket supply, or if the microprocessor 101 does not detect the solid marker passing over the wheel position optic sensor 58 in the appropriate amount of time), an error code may be displayed. When the error is corrected, the operator of the game can activate the test and program switches 102 to return to the "non-error" or normal mode of operation.

In accordance with one embodiment of the invention, hardware system 100 includes other components that may further enhance the operation of the system. For example, a token or playing piece switch 114 provides a signal to another input terminal of microprocessor 101 upon insertion of a token into the amusement device. As will be explained in more detail hereinafter, microprocessor 101 commences certain display updates, turns on various lights and plays music. For example, after a token is initially inserted or after a token is detected in one of the receptacle in spinning wheel 106, microprocessor 101 provides audio signals to audio output speaker 118 which is received at an input terminal on audio output speaker 118. Microprocessor 101 also provides a signal to a token or playing piece meter 116 which records and tracks the number of tokens which have been inserted.

Various controlled lights 62 are provided about front panel 22 and spinning wheel 24. Microprocessor 101 advantageously provides signals to an alternating current, A/C, control board 120 having A/C drive circuits which include optically isolated solid state relays which activate and control lights 62. The invention is not limited in this respect, however, and a direct current, DC supply may be substituted along with appropriate drive circuits for activating and controlling lights 62.

As the game is played and points are accumulated, microprocessor 101 provides signals to display indicator unit 124, which controls display 36 (shown in FIG. 1*a*), and which provides a running indication to the player of the amount of tickets which can be won corresponding to the big win receptacle 44*b* on spinning wheel 24. Display indicator unit 124 is not limited in this manner, however, and it may alternatively be configured to provide an indication of the amount of tickets which can be won corresponding to other receptacles 44 on spinning wheel 24 or it may indicate a running amount of the points accumulated. As such, as a player accumulates points, corresponding award tickets may be accumulated and awarded as a prize. A player generally attempts to accumulate a specific amount of tickets in order to trade in the tickets for a desired prize. To record and track the number of tickets accumulated by a player, microprocessor 101 provides signals to a ticket register 126 which contains an updated number of tickets that need to be dispensed. In response to the contents ticket register 126, a signal indicating the number of tickets which are to be awarded to a player is provided by microprocessor 101 to a ticket dispenser 128. Ticket dispenser 128 also provides signals to microprocessor 101, in response to which the microprocessor tracks and records the number of tickets which have been awarded as well as the number of tickets which may remain on a roll of tickets within device 10 so that a new roll of tickets may be replaced as necessary.

Figure 3:
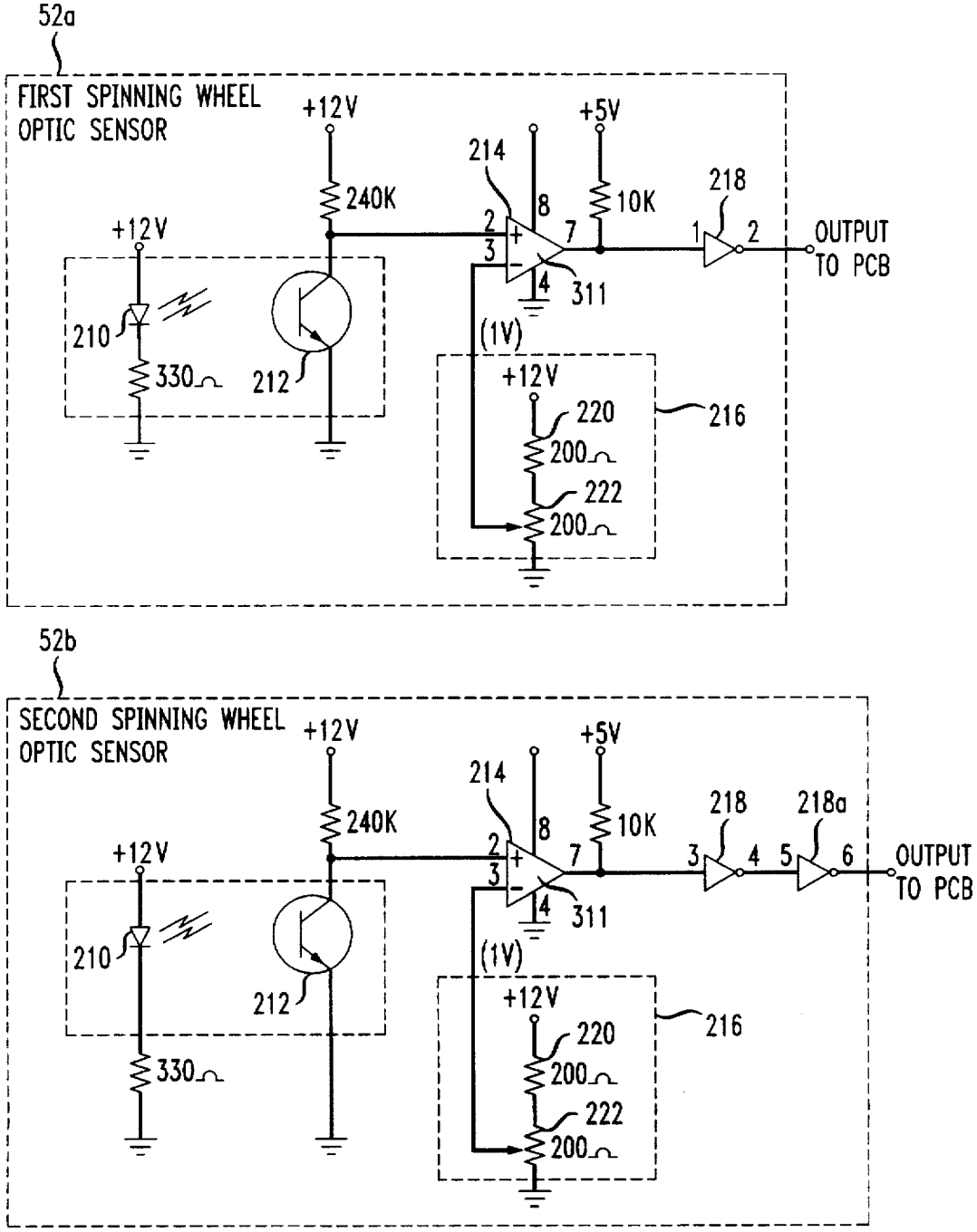
FIG. 3 is a schematic diagram of an optical sensing means corresponding to a large receptacle and a small receptacle according to one embodiment of the present invention.

FIG. 3 schematically illustrates the electrical circuitry for first and second spinning wheel optic sensors 52*a* and 52*b* (shown in FIG. 1*b*). It is noted that the wheel position optic sensor 58 employs the same arrangement discussed herein. Spinning wheel optic sensors 52*a*, 52*b* comprise a light emitting source, such as an L.E.D. 210 and an opto transistor 212 which is configured to receive the light emitted by LED 210 at its base terminal. The collector terminal of transistor 212 is coupled to the non-inverting input terminal of a comparator 214. The inverting terminal of comparator 214 is configured to receive a predetermined threshold voltage signal from a voltage divider 216 formed by resistors 220 and 222. The output terminal of comparator 214 is coupled to a buffer 218, which in turn provides an indication signal to microprocessor 101. As shown, second spinning wheel optic sensor 52*b* includes second buffer 218*a* which provides an indication signal to microprocesseor 101.

During operation, transistor 212 provides a voltage signal at its output terminal, in response to the light received from L.E.D. 210. The value of the voltage signal at the output terminal of transistor 212 is proportional to the intensity of the light received at the base terminal of transistor 212. The voltage signal provided by transistor 212 is then compared with the reference voltage signal provided by voltage divider 216. If the value of voltage signal provided by transistor 212 is smaller than the value of the reference voltage signal, comparator 214 generates a signal indicating the presence of a token or a marker on spinning wheel 106. The purpose of comparator 214, at least in part, is to ensure that the number of false indications is minimized due to background light or light reflected from different portions of the spinning wheel 106.

Figure 4A:
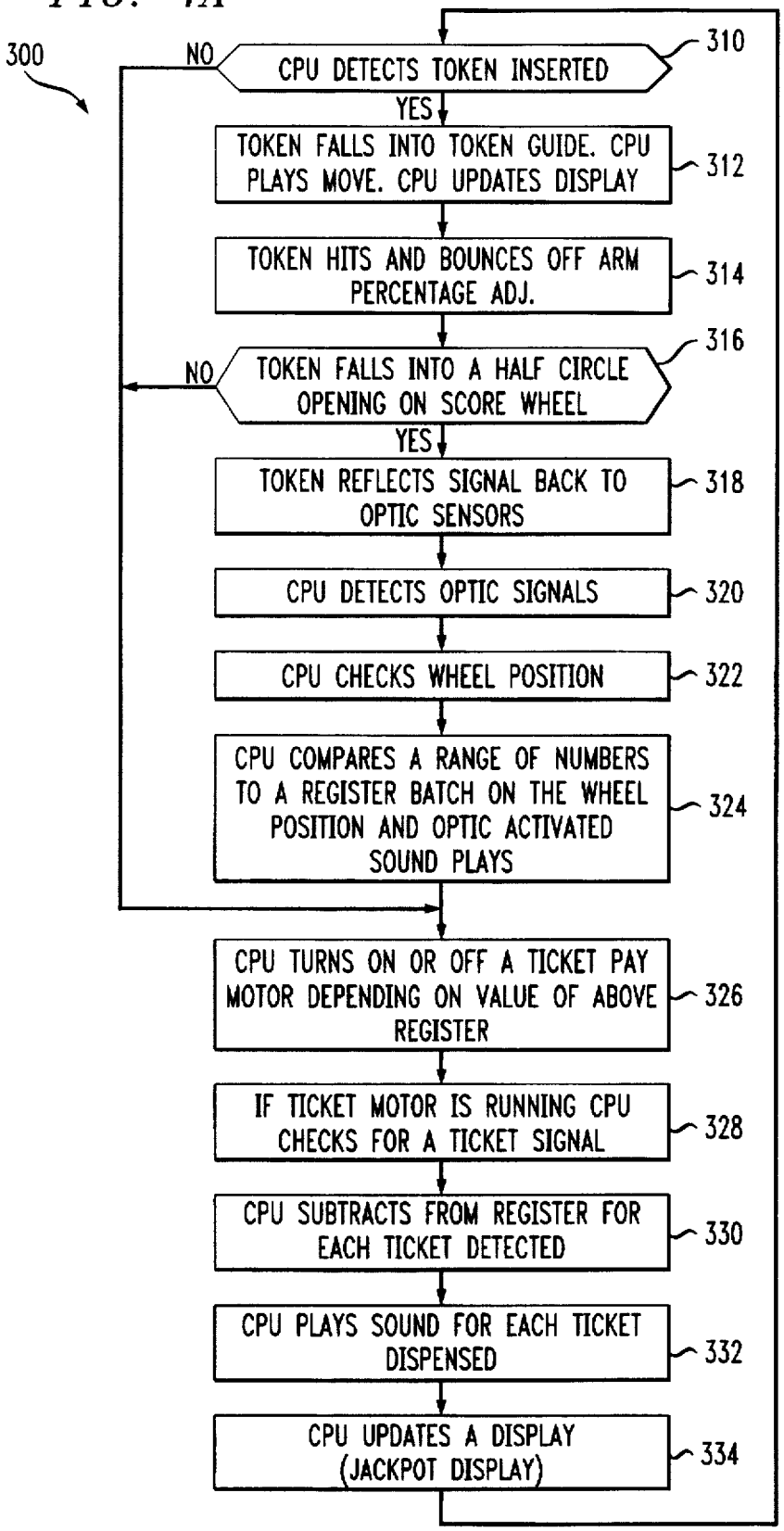
FIGS. 4*a* and 4*b* are flow diagrams which illustrate the sequence of operation of the main program loop, and the interrupt according to one embodiment of the spinning wheel amusement device of the present invention.

The main program loop 300 illustrated in FIG. 4*a* describes the steps employed in the playing of the spinning wheel amusement device 10 (shown in FIG. 1*a*), according to one embodiment of the present invention as illustrated in FIGS. 1*a* and 1*b*. The main program loop 300 commences with the insertion of a token or coin into insertion slot 30 on housing 12 (shown in FIG. 1*a*) and receipt and detection of the token in token guide 26 at step 310. If the token is not detected by the microprocessor at step 310, main program loop 300 skips to step 326 wherein the microprocessor provides a signal to ticket dispenser 128 (as shown in FIG. 2). Depending on how microprocessor has been programmed with respect to the awarding of tickets, the ticket dispenser 128, may upon receiving the signal from the microprocessor shut down thus preventing the dispensing of any tickets. Alternatively, the ticket dispenser 128 may be programmed and effectively activated to dispense one or a limited number of tickets as a consolation prize, and it will award any tickets owed to a player from a previous game.

If the token is detected by the microprocessor at step 310, the microprocessor provides audio signals to output speaker 118 (as shown in FIG. 2), for playing music, and to display indicator unit 124 for updating the display, at step 312, such that the value indicated on display 36 (shown in FIG. 1) is either increased by the value which has been programmed for big win receptacle 44*b* if a big win has been scored, is increased by one for each coin inserted, or is decreased by one corresponding to the ticket that has been dispensed in response to the receipt of a token in big win receptacle 44*b*. At step 314, the token is deflected off adjustment arm 34 and may then be successfully received in a receptacle 44 on spinning wheel 24 at step 316, or if not received in a receptacle 44, the token travels along peripheral token guide 56 around spinning wheel 24 eventually falling into token storage chamber 42 in housing 12. If the token successfully falls into a receptacle 44 on spinning wheel 24, the token will reflect a light signal to one of the optic transistors employed by spinning wheel optic sensors 52*a* or 52*b* at step 318, depending upon whether the token is received in a small win receptacle 44*a*, or a big win receptacle 44*b*. The microprocessor detects the signal at step 320 and then checks the position of spinning wheel 24 at step 322 by retrieving the contents of distance traveled register as described above in reference with FIG. 2.

In accordance with one embodiment of the invention, the microprocessor is configured to assign a predetermined prize or award to the player based on the contents of distance traveled register 130 at the time the existence of a token is sensed in a receptacle 44. To this end an award array may be created which corresponds each wheel position to a number that represents the location of the receptacle 44 that has received a token. For example, a number N1 is assigned, if a token is sensed when the wheel position is at L1. A number N2 is assigned, if a token is sensed when the wheel position is at L2 and so forth. Numbers N1 and N2 correspond to the value of the award that is allocated to the player, based on the position of the receptacle 44 that receives a token. In accordance with one embodiment of the invention a number N is assigned to a range of adjacent wheel positions, to take account the width of each receptacle 44.

At step 324, the microprocessor retrieves the appropriate award N based on the contents of distance traveled register 130 and adds that appropriate award to ticket register 126. The ticket register 126 keeps track of the total amount of awards a player accumulates during a game session. It is noted that the allocation of awards to the player is not limited to the arrangement discussed herein and the invention is not limited in this respect. Other arrangements for determining the position of the receptacle that receives the token, and awarding a corresponding prize may be implemented in accordance with the principles of the present invention. For example, the location of each receptacle 44 that receives a token can be determined directly, and an award can be then allocated based on that determined location. The microprocessor also continues, at step 324, to provide signals to the audio output speaker 118 for sound play.

After determining the position of the receptacle 44 that has received the token at step 324, the microprocessor allocates the number of tickets or additional playing pieces to be dispensed and which corresponds to the position of the receptacle 44. Based upon whether the token was received in a small win receptacle 44*a*, a big win receptacle 44*b*, or whether the token exited the spinning wheel of front panel 22 via exit end 56 of peripheral token guide 54, the microprocessor provides an activation signal to the ticket dispenser motor at step 326. If tickets are to be awarded, the microprocessor checks for a signal at step 328, which indicates the number of tickets that have been dispensed At step 330, the microprocessor subtracts from ticket register 126 the number of tickets distributed and provides a signal to ticket dispenser 128. At step 332, microprocessor provides a signal to audio output speaker 118, which plays music as tickets are dispensed from ticket dispenser 128. At step 334, microprocessor provides a signal to display indicator unit 124 which visually displays on display indicator 36 the number of tickets remaining to be dispensed upon receipt of a token in big win receptacle 44*b*.

Figure 4B:
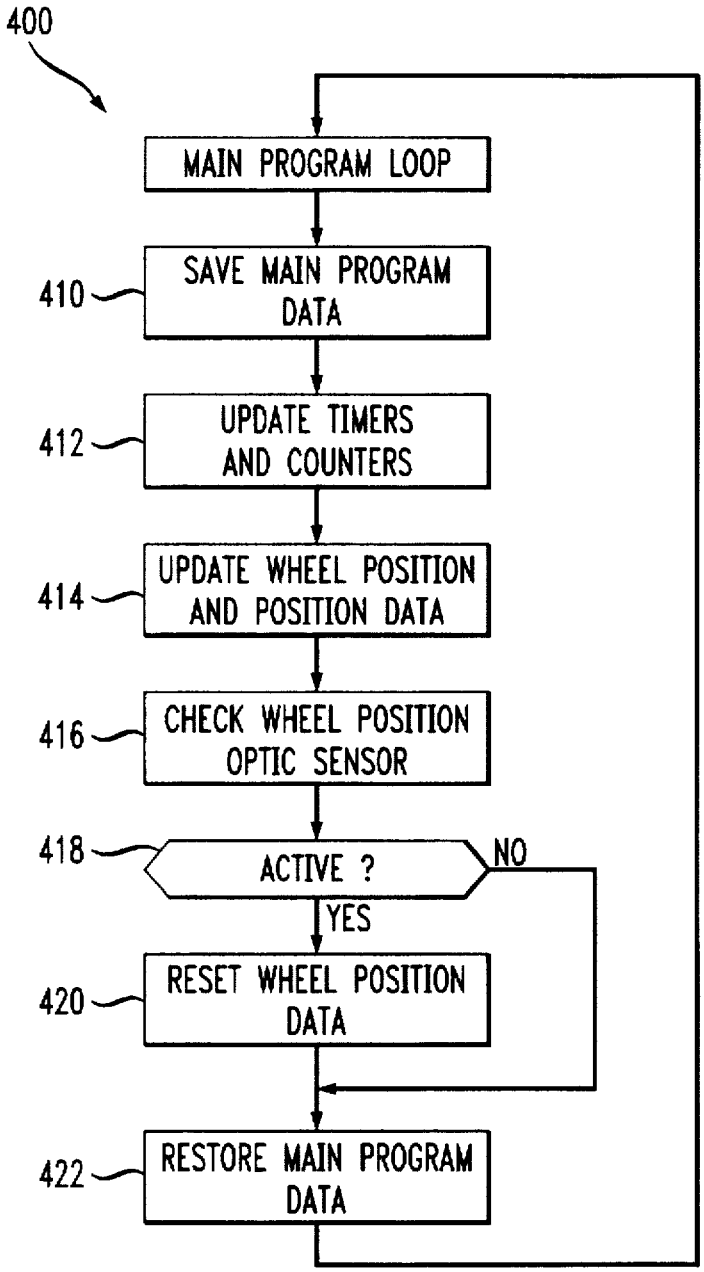

In FIG. 4*b* there is illustrated a main program loop interrupt service routine 400 employed by the main program loop. Every 0.001 seconds during the main program loop 300, the main program data is saved at step 410. All timers and counters are updated at step 412. At step 414 the distance traveled register is updated based on the signals provided to the stepper motor 110. Wheel position optic sensor is then checked at step 416 to determine whether the marker on the spinning wheel has passed by the wheel position optic sensor at step 418. If so, the contents of distance traveled register is reset to zero at step 420, and the system goes to step 422 to restore the main program data and return to the main loop. If, at step 418, no marker indicating signal is detected, the system goes directly to step 422, without resetting the distance traveled register.

It is to be understood that the present invention is not limited to the embodiment as described hereinabove. In an alternative embodiment, the spinning wheel amusement device 10 may include an exiting slot such that additional tokens or coins are awarded to a player upon the successful receipt of a token or coin in a receptacle 44 on spinning wheel 24. In another alternative, the general concept of the game encompassed by the spinning wheel amusement device 10 as described hereinabove, is written as a computer program and stored on a diskette or CD-ROM for loading into a computer system to be played on a computer monitor.

Thus, while there have been shown and described and pointed out fundamental novel features of the invention as applied to preferred embodiments thereof, it will be understood that various omissions and substitutions and changes in the form and details of the disclosed invention may be made by those skilled in the art without departing from the spirt of the invention. It is the intention, therefore, to be limited only as indicated by the scope of the claims appended hereto. It is to be understood that the drawings are not necessarily drawn to scale, but that they are merely conceptual in nature.

What is claimed is:

1. A spinning wheel amusement device, comprising:

a token guide for receiving tokens;

a spinning wheel having an external periphery configured to receive a token from said token guide, said spinning wheel having a plurality of openings spaced circumferentially around said periphery of said spinning wheel for receiving said token therein wherein said spinning wheel comprises a front plate and a back plate attached together so as to define said openings for receiving said token; and a calculator adapted to provide a corresponding award depending on the position of said token in one of said receptacles.

2. The spinning wheel amusement device as recited in claim 1, wherein said receptacles on said spinning wheel are of various sizes.

3. The spinning wheel amusement device as recited in claim 1, further comprising a sensor, said sensor configured to determine the existence of a token in one of said openings on said spinning wheel.

4. The spinning wheel amusement device as recited in claim 3, wherein said sensor is an optical sensor.

5. The spinning wheel amusement device as recited in claim 3, wherein said sensor is an electrical sensor.

6. The spinning wheel amusement device as recited in claim 3, further comprising a microprocessor, said microprocessor programmed to receive a signal from said sensor means for storing the position of said spinning wheel while it is rotating; and said microprocessor configured to retrieve the position of said spinning wheel from said position storing means at the time said token was sensed.

7. The spinning wheel amusement device as recited in claim 6; wherein said spinning wheel is rotated via a motor.

8. The spinning wheel amusement device as recited in claim 7, wherein said motor is a stepper motor, and wherein said microprocessor tracks the position of said stepper motor based on signals provided to said stepper motor.

9. The spinning wheel amusement device as recited in claim 7, wherein said microprocessor awards a predetermined value corresponding to said opening on said spinning wheel in which said token has been received.

10. The spinning wheel amusement device as recited in claim 1, wherein said token guide further comprises an adjustment arm, said adjustment arm connected to said token guide at point proximate said spinning wheel for deflecting said token before said token falls to said spinning wheel.

11. A spinning wheel amusement device, comprising:

a housing having a front face comprising a translucent plate to permit viewing through said front face;

a token guide for receiving tokens;

a spinning wheel having a first and second plate attached together and having an external periphery, said spinning wheel defining openings between said first and second plate, said openings spaced circumferentially around said periphery of said spinning wheel;

a motor for rotating said spinning wheel;

a sensor for sensing when a token has been received in one of said openings on said spinning wheel; and a microprocessor programmed to receive a signal from said sensor, said microprocessor configured to retrieve the position of said spinning wheel at the time said token was sensed.

12. The spinning wheel amusement device as recited in claim 11, wherein said openings on said spinning wheel comprise semi-circular receptacles for receiving and retaining said token therein.

13. The spinning wheel amusement device as recited in claim 11, wherein said motor is a stepper motor, and wherein said microprocessor tracks the position of said stepper motor based on signals provided to said stepper motor.

14. The spinning wheel amusement device as recited in claim 11, wherein said microprocessor awards a predetermined value corresponding to said opening on said spinning wheel in which said token has been received.

15. The spinning wheel amusement device as recited in claim 14, further comprising a ticket dispenser for dispensing a number of tickets corresponding to said predetermined value when a token is received in an opening on said spinning wheel.

16. A spinning wheel amusement device, comprising:

means for receiving a token into said housing;

a spinning wheel having a first and second plate attached together and having an external periphery, said spinning wheel defining openings between said first and second plate, said openings spaced circumferentially around said periphery of said spinning wheel;

means for rotating said spinning wheel, said rotating means connecting to said spinning wheel;

sensing means positioned beneath said spinning wheel for sensing when a token has been received in one of said openings on said spinning wheel; and a microprocessor for receiving a signal from said sensing means, said signal indicating the existence of a token in one of said openings on said spinning wheel, said microprocessor providing an award based on the location of said opening that receives said token.

17. The spinning wheel amusement device as recited in claim 16, wherein said means for rotating said spinning wheel is a motor.

18. The spinning wheel amusement device as recited in claim 17, wherein said motor is a stepper motor, and wherein said microprocessor tracks the position of said stepper motor based on signals provided to said stepper motor.

19. The spinning wheel amusement device as recited in claim 16, wherein said sensing means is an optical sensor.

20. A spinning wheel amusement device, comprising:

a token guide for receiving tokens;

a spinning wheel having an external periphery configured to receive a token from said token guide, said spinning wheel having a plurality of openings spaced circumferentially around said periphery of said spinning wheel for receiving said token therein wherein said openings comprise semi-circular receptacles having various sizes for receiving said token therein, wherein a predetermined award is allocated to each one of said openings; and a calculator adapted to generate a corresponding allocated award when a token is sensed in one of said openings.

21. The spinning wheel amusement device as recited in claim 20, further comprising a sensor, said sensor configured to determine the existence of a token in one of said openings on said spinning wheel.

22. The spinning wheel amusement device as recited in claim 21, further comprising a microprocessor, said microprocessor programmed to receive a signal from said sensor, said microprocessor configured to retrieve the position of said spinning wheel at the time said token was sensed.

23. The spinning wheel amusement device as recited in claim 22, wherein said spinning wheel is rotated via a motor.

24. The spinning wheel amusement device as recited in claim 23, wherein said motor is a stepper motor, and wherein said microprocessor tracks the position of said stepper motor based on signals provided to said stepper motor.

25. A spinning wheel amusement device, comprising:

a token guide for receiving tokens;

a spinning wheel rotated via a stepper motor, said spinning wheel having an external periphery configured to receive a token from said token guide, said spinning wheel having a plurality of openings spaced circumferentially around said periphery of said spinning wheel for receiving said token therein; and a microprocessor adapted to provide a corresponding award depending on the position of said token in one of said receptacles, wherein said microprocessor tracks the position of said stepper motor based on signals provided to said stepper motor.

* * * * *